US007434528B1

(12) United States Patent
McKibben

(10) Patent No.: US 7,434,528 B1
(45) Date of Patent: Oct. 14, 2008

(54) SELF DRAINING BOAT PLUG

(76) Inventor: Larry G. McKibben, 1170 Hall Rd., Nesbitt, MS (US) 38651

( * ) Notice: Subject to any disclaimer, the term of this patent is extended or adjusted under 35 U.S.C. 154(b) by 452 days.

(21) Appl. No.: 11/336,798

(22) Filed: Jan. 20, 2006

(51) Int. Cl.
*B63B 13/00* (2006.01)

(52) U.S. Cl. ..... 114/197

(58) Field of Classification Search .. 114/183 R–183 A, 114/197, 198; 137/533.17, 533.27, 533.29
See application file for complete search history.

(56) References Cited

U.S. PATENT DOCUMENTS 233,547 A * 10/1880 Raymond ..... 114/197
275,270 A 4/1883 Renton
291,353 A * 1/1884 Jobin ..... 114/185
414,240 A * 11/1889 Norton ..... 114/183 R
1,079,627 A * 11/1913 Adams ..... 114/197
1,602,093 A 10/1926 Andrew
2,367,718 A 1/1945 Farrell
3,394,671 A 7/1968 Mayer
4,217,846 A 8/1980 Wight
4,986,206 A * 1/1991 Knight et al. ..... 114/183 R
6,357,376 B1 3/2002 Purio
6,615,760 B1 9/2003 Wise et al.
6,634,312 B2 10/2003 Warner et al.

* cited by examiner

*Primary Examiner*—Ajay Vasudeva
(74) *Attorney, Agent, or Firm*—Wyatt, Tarrant & Combs, LLP

(57) ABSTRACT

The present invention provides an improved self draining boat plug which does not need to be repetitively removed and reinserted into a boat. The boat plug is specifically designed to allow water to escape from the boat while the boat is at cruising speed or removed from the water. Additionally, the drain plug blocks water from entering the boat while the boat is in the water. The drain plug is designed for durability, and continued performance when exposed to the hazards typically encountered in its working environment.

19 Claims, 4 Drawing Sheets

SELF DRAINING BOAT PLUG

CROSS REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to boats, and specifically to boat plugs. The present invention is a boat plug which does not need to be repetitively inserted and removed.

BACKGROUND OF THE INVENTION

During ordinary use of a boat water will accumulate in the vessel. In recognition of this fact, boats are manufactured with a drain hole in order to allow drainage of any water taken on during use or the drainage of water which is used to clean the boat. Obviously, when the boat is used in water, it is necessary to have a drain plug properly installed in order to avoid taking on significant amounts of water which may, ultimately, sink the boat. Conversely, when the boat is not in use, or out of the water, removal of the drain plug is preferred in order to remove any water which may be collected within the boat. Even experienced boaters may, on occasion, fail to insert, or properly insert, a drain plug prior to launching their boat into water.

It is necessary for a boat plug to be durable in order to properly perform its task. Hazards to the boat plug include exposure to UV light, oil, gasoline and other foreign compositions or matter located within water. Accordingly, there are serious shortcomings with regard to the boat plugs which are currently in use.

Clearly, there is a need for a boat plug which does not require repetitive insertion and removal and provides the durability necessary to properly function in view of the hazards faced while the boat is both in the water and out of the water. Such a boat plug would need to prevent water from entering the boat while the boat is in use and allow water within the boat to rapidly escape while the boat is operated at a cruising speed or while the boat is removed from the water.

SUMMARY OF THE INVENTION

The present invention is an automatically draining boat plug. When the boat plug is installed in a boat, it allows water within the boat to drain when the boat plug is positioned about water level. When the boat plug is submerged beneath the water surface, it prevents water from entering the boat. Accordingly, there is no need to remove and subsequently replace the boat plug, as is currently required by ordinary boat plugs. The use of a boat plug which is always present within the boat eliminates the possibility of inadvertently placing a boat in the water without a plug. Further, in certain embodiments, when a boat is at a cruising speed the boat plug is located above the surface of the water and water present in the boat is rapidly drained.

The boat drain plug includes a first member, a cylindrical valve, and a second member. The first member has a first opening, and a cylindrical flange. The cylindrical valve is slideably engaged within the cylindrical flange of the first member. The cylindrical valve has a plurality of notches and an arm which is sized to be received within the opening of the first member in order to block water from traveling therethrough. The second member is attached to the cylindrical flange of the first member, with the cylindrical valve slideably engaged therebetween, the second member having a plurality of spacers in order to prevent the cylindrical valve from contacting the second member. In certain embodiments the cylindrical valve defines a concave space. In other embodiments, each of the plurality of notches of the cylindrical valve is a minimum of 60 square millimeters. In still other embodiments, each of the plurality of spacers on the second member has a height of at least 2.5 millimeters. In still other embodiments, each of the plurality of spacers has a height of from about 2.5 millimeters to about 3.5 millimeters. In still other embodiments, the plurality of spacers may include three or four spacers.

In still other embodiments of the safety boat plug, the present invention includes a first member defining a first opening, a first flange which defines an interior space and a second flange, a second member attached to the first flange of the first member, having a first opening, and a plurality of spacers, a disc received in the interior space of the first flange of the first member, the disc having a cylindrical member extending axially from the first side for being received by the first opening of the first member, the disc having a plurality of notches. In certain embodiments, the disc is constructed of a buoyant material. In other embodiments, the cylindrical member of the disc defines an inset for receiving a gasket. In still other embodiments, the first flange of the first member is from about 15 mm to about 20 millimeters. In other embodiments, the first flange of the first member is about 17.5 millimeters. In still other embodiments, the disc defines a concave space.

In another embodiment, the automatically draining boat plug includes a first member defining a centrally located first opening, and having a flange about the periphery and extending axially therefrom, a valve being generally flat engaged within the flange of the first member, the valve defining the plurality of notches about the periphery, the valve having an arm, the arm having an inset for receiving a gasket, a second member attached to the flange of the first member, the second member defining a centrally located first opening, the second member having a plurality of spacers positioned around the first opening. In certain embodiments, the arm of the valve is sized to engage the first opening of the first member. In other embodiments, the invention further includes a gasket received in the inset of the arm of the valve. In still other embodiments, each of the plurality of the spacers has a height from about 2.5 millimeters to about 3.5 millimeters. In still other embodiments, the distance between each of the plurality of spacers is at least 10 millimeters. And in other embodiments, the flange of the first member is from about 10 millimeters to about 12 millimeters.

Accordingly, a first aspect of the present invention is to provide a boat plug which does not need to be removed and reinserted repeatedly as the boat is placed in and removed from water.

Another aspect of the present invention is a boat plug which conveniently and rapidly drains water from the inside of a boat when the boat plug is located above the water surface level.

Still another aspect of the present invention is providing a boat plug which automatically drains water from the boat while the boat is moving at a cruising speed.

Still another aspect of the present invention is a relatively inexpensive boat plug which is designed to avoid being plugged up so that any water in a boat is rapidly drained therefrom.

DETAILED DESCRIPTION OF THE INVENTION

Figure 9:
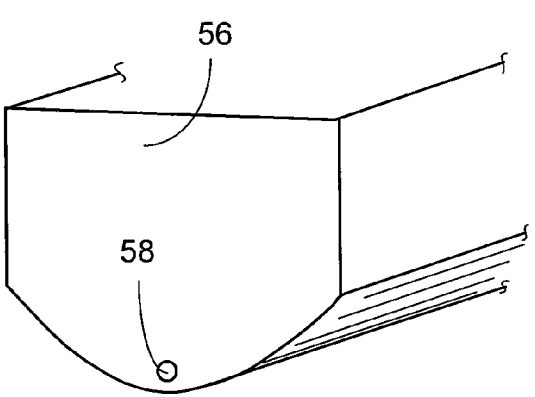
FIG. 9 is a perspective view of the rear side of a boat.

The invention disclosed herein is a boat drain plug 10. The boat drain plug 10 replaces the traditional boat plug which is removed after use of a boat in water in order to remove any water present in the boat. The drain hole 58 of a boat 56 may be located in the rear of the boat 56, as best seen in FIG. 9, or at other locations at the discretion of the boat 56 manufacturer. An advantage of the present invention is that removal and reinsertion of the plug 10 is not required. The present invention engages and attaches to the drain hole 58 of a boat 56 in a similar manner to currently existing boat plugs. In certain embodiments, the present invention may be fastened to the boat 56 One skilled in the art of boating is familiar with the proper insertion of a boat plug into the drain hole 58 of a boat 56. The plug 10 is designed to allow water to escape from the boat at any point when the plug 10 is above the surface of the water. The specific design of the present plug 10 is superior to the currently existing boat plugs due to the superior seal provided when the boat plug is in use. Additionally, when a boat is removed from the water, the rate of removal of any water within the boat provides quick drainage.

Figure 1:
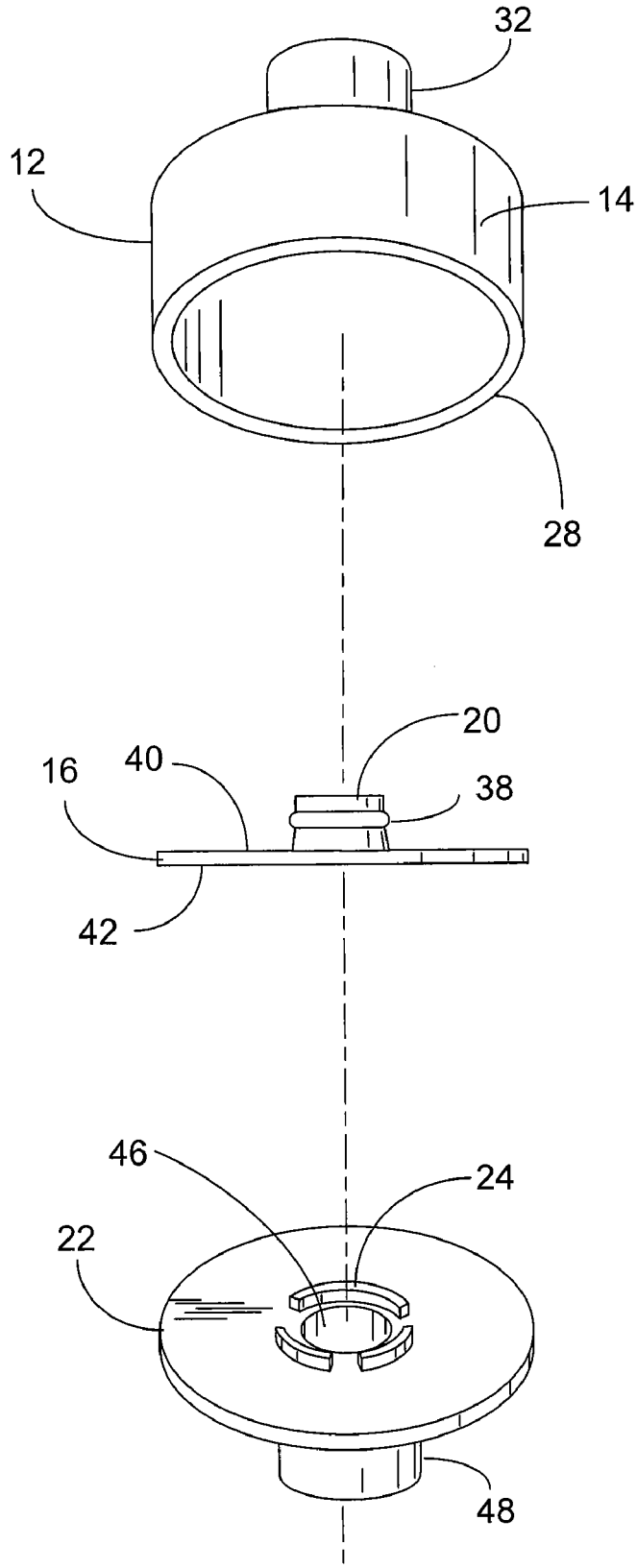
FIG. 1 is a perspective view of a first embodiment of the present invention.
Figure 4:
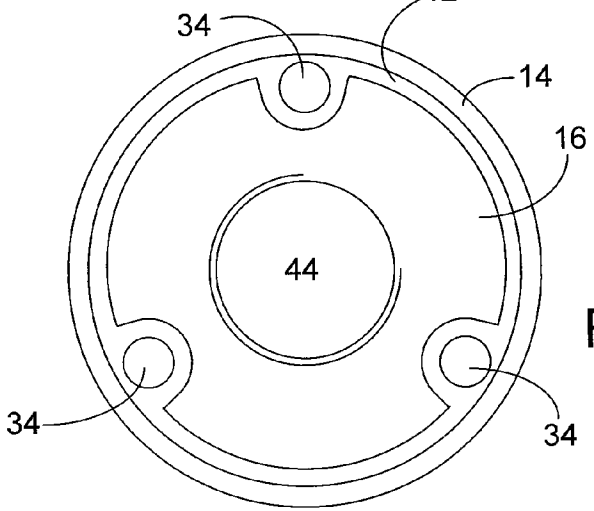
FIG. 4 is a bottom view of the first member of the present invention with the valve properly positioned therein.
Figure 6:
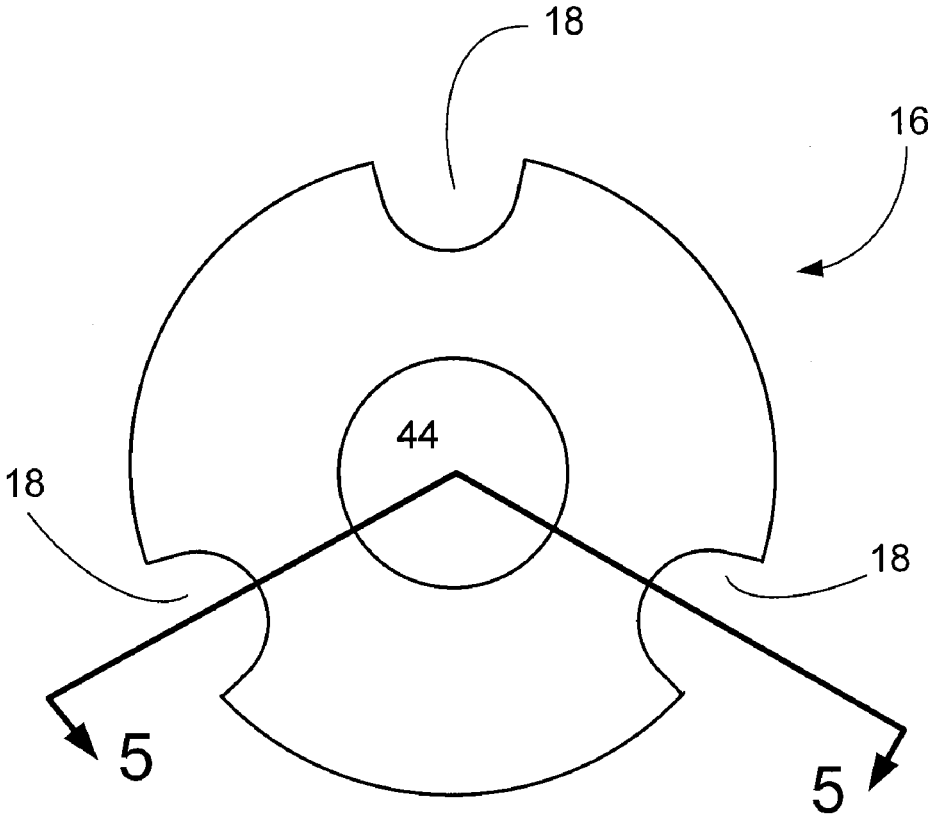
FIG. 6 is a bottom view of the valve of the present invention.
Figure 7:
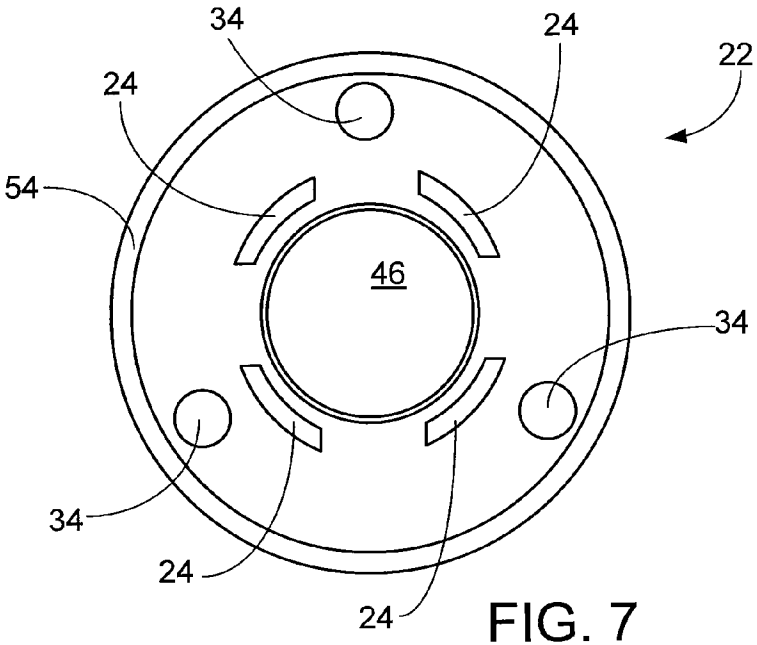
FIG. 7 is a top view of the second member of the present invention.

Referring to FIG. 1, there is shown a perspective view of the present invention. The present invention includes a first member 12, a cylindrical valve 16, and a second member 22. The cylindrical valve 16 is slideably engaged between the first member 12 and the second member 22. Due to buoyancy the cylindrical valve 16 will float upward and press against the first member 12 when the boat plug is located below the water surface. When the boat drain plug 10 is located above the water surface, the cylindrical valve 16 will press against the second member 22. Movement of water through the present invention, or water force, may also result in movement of the cylindrical valve 16. Thus, water moving through the boat drain plug 10 in the direction of the first member 12 results in the cylindrical valve 16 moving that direction and being pressed against the first member 12, as further described herein. Alternatively, water moving through the boat drain plug 10, or water force, in the direction of the second member 22 results in the cylindrical valve 16 moving that direction and being pressed against the spacers 24 of the second member 22, as further described herein. The first member 12 and second member 22 each define openings, as best seen in FIGS. 4 and 7, through which water may travel. The cylindrical valve 16 is solid in the interior section and has notches about the periphery, as best seen in FIG. 6. Accordingly, as the cylindrical valve 16 floats up and presses against the first member 12, water is not permitted to travel through the plug 10. However, when the cylindrical valve 16 presses against the second member 22 water is allowed to pass through the plug 10 because the cylindrical valve 16 is resting upon spacers 24. As used herein, valve 16 may also be referred to as a disc.

Figure 2:
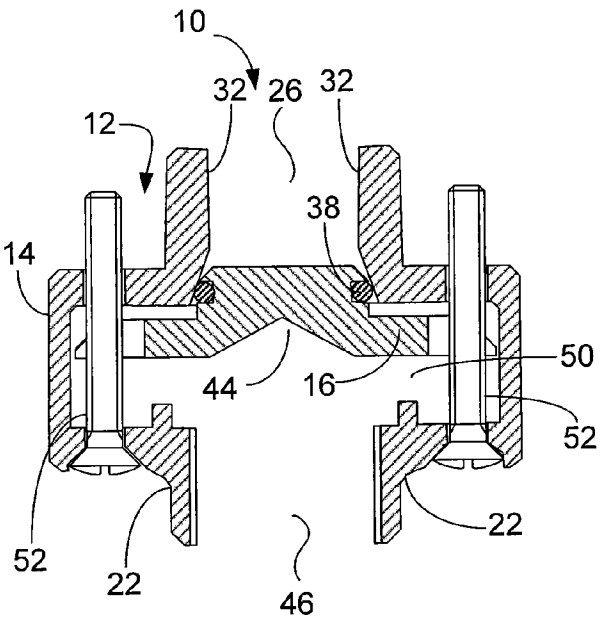
FIG. 2 is a cross sectional side view of a first embodiment of the present invention.

Referring now to FIG. 2, there is shown a cross sectional view of the present invention. Within FIG. 2, the cylindrical valve 16 is located in an upward position which prohibits water from flowing through the plug 10. The cylindrical valve 16 is slideably engaged in the interior space 50, between the first member 12 and second member 22 so that the cylindrical valve 16 may in essence allow the plug 10 to be open for water flow or close to prevent water flow. The current embodiment of the present invention is one in which the first member 12 and the second member 22 are held together by bolts 52 and nuts. The first member 12 and second member 22 may be constructed from any rigid materials suitable for the purposes disclosed herein. Specific examples of material of construction include: brass, gun metal, etc. In certain other embodiments, the first member 12 and second member 22 may be permanently attached by a chemical adhesive, welding or the like. One of ordinary skill in the art is familiar with the manufacture of specifically shaped members, as disclosed herein, constructed of the aforementioned suitable materials.

Figure 3:
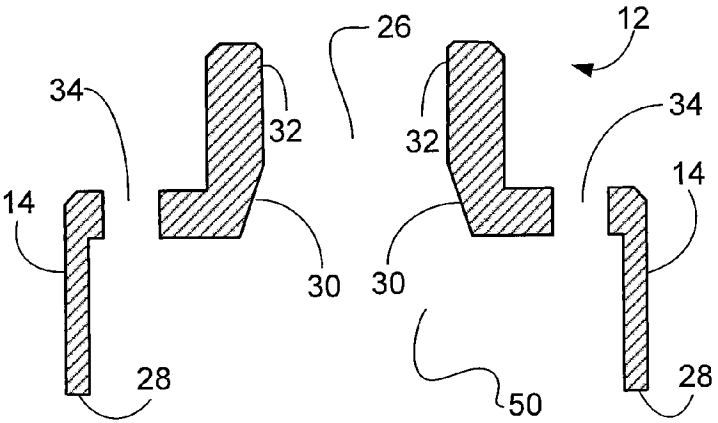
FIG. 3 is a cross sectional side view of the first member of the present invention.

Referring now to FIG. 3, there is shown a cross sectional view of the first member 12. The first member 12 defines a first opening 26 and has a cylindrical flange 14, the flange 14 having a first end 28. As best seen in FIG. 1, when the boat drain plug 10 is assembled, it is the length of the flange 14 which defines the amount of space in which the cylindrical valve 16 has to move. Stated another way, the length of the flange 14 acts as a guide for the movement of the cylindrical valve 16, as further described above. In certain embodiments, the flange 14 of the first member 12 is from about 10 mm to about 12 mm. Such a length is important to proper movement of the cylindrical valve 16 and proper function of the invention. The first member 12 defines the first opening 26 such that the opening narrows as it proceeds away from the cylindrical flange 14. The angled surface 30 provides for a tight fit upon the engagement of the cylindrical valve 16. In certain embodiments the angled surface 30 is at an angle of approximately 18 degrees. In still other embodiments, the angled surface 30 may be at an angle from about 15 degrees to about 25 degrees. Again, the specific angle of the angled surface 30 is important since the angles disclosed herein result in a tight closure with the cylindrical valve 16 upon engagement. The first member 12 additionally includes a collar 32. The collar 32 is similar in dimension and application to existing boat plugs.

Referring now to FIG. 4, there is shown a bottom view of the first member 12 with the valve 16 positioned within the flange 14. Shown there is the flange 14 about the periphery, the concave space 44 on the second side 42, also called the bottom side, of the valve, and the bolt openings 34 for receiving the bolts 52 to attach the first member 12 to the second member 22, in certain embodiments.

Figure 5:
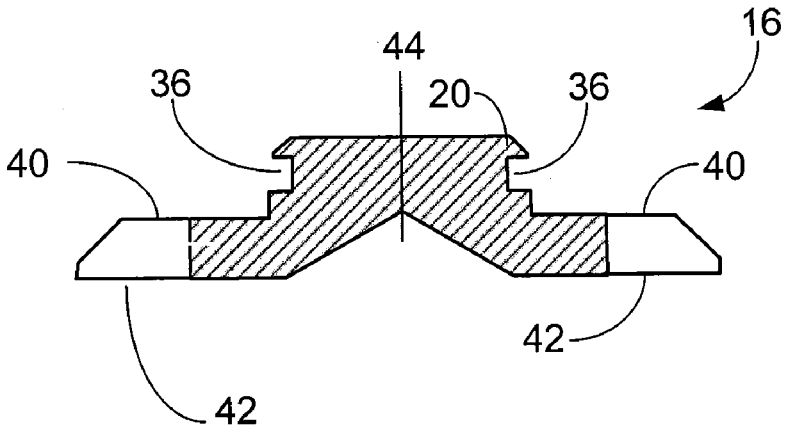
FIG. 5 is a cross sectional side view of the cylindrical valve of the present invention.

Referring to FIG. 5, there is shown a side cross sectional view of the cylindrical valve 16. The valve 16 is constructed from a buoyant and rigid material. Examples of such materials include plastic, nylon, teflon, etc. One of ordinary skill in the art is familiar with injection molding, and the like which may be used to manufacture a valve 16 having the specific design features disclosed herein. As can be seen in the figure, the valve 16 includes an arm 20 which removeably engages the first opening 26 of the first member 12. In certain embodiments, the arm 20 has an inset 36 which may receive an o-ring gasket 38. The gasket 38 may enhance the closure of the first opening 26 of the first member 12. The valve 16 has a first side 40 and second side 42. The second side 42 of the valve 16 defines a concave space 44. The concave space 44 defines an angle of approximately 120 degrees and is for receiving water in order to assist in the movement of the valve 16 towards the first member 12. As best seen in FIG. 6, the valve 16 defines a plurality of notches 18 about the periphery of the valve 16. The notches 18 allow movement of water beyond the valve 16. Also, in certain embodiments, the notches allow the passage of the bolts attaching the first member 12 to the second member 22.

Referring now to FIG. 7, there is shown a top view of the second member 22. Like the first member 12, the second member 22 defines a first opening 46. In certain embodiments the second member 22 may include bolt openings 34 for receiving bolts 52 for attachment to the first member 12. The second member 22 has plurality of spacers 24 in order to obstruct contact of the second side 42 of the valve 16 with parts of the second member 22 other than the spacers 24. In certain embodiments the second member 22 may have at least two spacers. In other embodiments, there may be three, four, five, or six spacers. The spacers 24 may be constructed of material identical to the second member 22. In alternate embodiments, the spacer may be constructed of another suitable, and rigid material. One of ordinary skill in the art is familiar with the selection of suitable materials. In certain embodiments, the second member 22 may define a lip 54 about its periphery. In certain embodiments, the spacer 24 has a height of about 2.5 mm. In other embodiments, the height of the spacer is from about 2.5 mm to about 3.5 mm. In certain other embodiments, the distance between each of the plurality of spacers 24 is at least 10 mm. The spacing is important to allow rapid water flow through the boat drain plug 10.

Figure 8:
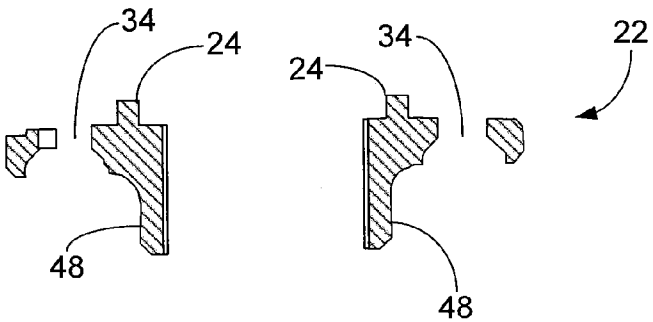
FIG. 8 is a cross sectional side view of the second member of the present invention.

Referring now to FIG. 8, there is shown a side cross sectional side view of the second member 22. In certain embodiments the second member 22 may be designed to have insets for the heads of bolts which are used to attach the second member 22 to the first member 12. In certain embodiments, the second member 22 may include a collar 48.

All references, publications, and patents disclosed herein are expressly incorporated by reference.

Thus, it is seen that the present invention readily achieves the ends and advantages mentioned as well as those inherent therein. While certain preferred embodiments of the invention have been illustrated and described for purposes of the present disclosure, numerous changes in the arrangement and construction of the parts may be made by those skilled in the art, which changes are encompassed within the scope and spirit of the present invention as defined by the following claims.

What is claimed is:

1. A drain plug on a boat, comprising:

a first member defining a first opening, the first member having a cylindrical flange, the cylindrical flange having a first end;

a cylindrical valve slideably engaged in the cylindrical flange of the first member, the cylindrical valve having a first side and a second side, the cylindrical valve defining a plurality of notches, the first side of the cylindrical valve having an arm sized to be received in the first opening of the first member;

a second member attached to the first end of the cylindrical flange of the first member, the second member defining a first opening, the second member having a plurality of spacers on a first surface of the second member for preventing the cylindrical valve from contacting the first surface of the second member.

2. The drain plug of claim 1, further comprising the second side of the cylindrical valve defining a concave space.

3. The drain plug of claim 1, wherein each of the plurality of notches is a minimum of 60 $mm^2$.

4. The drain plug of claim 1, wherein each of the plurality of spacers has a height of at least 2.5 mm.

5. The drain plug of claim 4, wherein each of the plurality of spacers has a height of from about 2.5 mm to about 3.5 mm.

6. The drain plug of claim 1, wherein the plurality of spacers is three.

7. The drain plug of claim 1, wherein the plurality of spacers is four.

8. A safety plug on a boat, comprising:

a first member defining a first opening, the first member having a first side and a second side, the first member having a first flange on the first side defining an interior space and a second flange on the second side;

a second member defining a first opening, the second member having a first side and a second side, the second side of the second member attached to the first flange of the first member, the second side of the second member having a plurality of spacers, the second member having a first flange on the first side;

a disc received in the interior space of the first flange of the first member, the disc having a first side and a second side, the disc having a cylindrical member extending axially from the first side for being received by the first opening of the first member, the disc defining a plurality of notches.

9. The plug of claim 8, wherein the disc is constructed of a buoyant material.

10. The plug of claim 9, wherein the cylindrical member of the disc defines an inset for receiving a gasket.

11. The plug of claim 10, wherein the first flange of the first member is from about 15 mm to about 20 mm.

12. The plug of claim 11, wherein the first flange of the first member is about 17.5 mm.

13. The plug of claim 9, wherein the second side of the disc defines a concave space.

14. An automatically draining plug on a boat, comprising:

a first member defining a centrally located first opening, the first member having a flange about a periphery extending axially therefrom;

a valve being generally flat slideably engaged within the flange of the first member, the valve defining a plurality of notches about a periphery, the valve having a first side and a second side, the first side having an arm, the arm having an inset for receiving a gasket;

a second member attached to the flange of the first member, the second member defining a centrally located first opening, the second member having a plurality of spacers positioned around the first opening for preventing the valve from contacting a first surface of the second member.

15. The boat plug of claim 14, wherein the arm of the valve is sized to engage the first opening of the first member.

16. The boat plug of claim 14, further comprising a gasket received in the inset of the arm of the valve.

17. The boat plug of claim 16, wherein each of the plurality of spacers has a height of from about 2.5 mm to about 3.5 mm.

18. The boat plug of claim 17, wherein a distance between each of the plurality of spacers is at least 10 mm.

19. The boat plug of claim 18, wherein the flange of the first member is from about 10 mm to about 12 mm.

* * * * *